US006155502A

United States Patent [19]

Liou et al.

[11] Patent Number: 6,155,502

[45] Date of Patent: Dec. 5, 2000

[54] NOZZLE DEVICE FOR PURGING A VACUUM PUMP

[75] Inventors: Ming-Shinn Liou; Tean-Mu Shen; Cheng-Chan Tsai, all of Hsinchu; Jung-Chen Chien, Chupei; Tsung-Hsin Lin, Hsinchu, all of Taiwan

[73] Assignee: Industrial Technology Research Institute, Hsinchu, Taiwan

[21] Appl. No.: 09/378,694

[22] Filed: Aug. 23, 1999

[30] Foreign Application Priority Data

May 7, 1999 [TW] Taiwan ..... 88207311

[51] Int. Cl.[7] ..... B05B 1/14; F04B 23/00; F04B 39/00

[52] U.S. Cl. ..... 239/556; 417/313

[58] Field of Search ..... 239/556, 557, 239/558; 417/313

[56] References Cited

U.S. PATENT DOCUMENTS

| | | | |
|---|---|---|---|
| 2,647,800 | 8/1953 | Burnam et al. | 239/556 |
| 3,092,333 | 6/1963 | Gaiotto | 239/558 |
| 3,439,997 | 4/1969 | Hancock et al. | 239/556 |
| 4,588,131 | 5/1986 | Yamamoto et al. | 239/600 |
| 5,857,623 | 1/1999 | Miller et al. | 239/558 |

FOREIGN PATENT DOCUMENTS

| | | | |
|---|---|---|---|
| 1250-330 | 8/1986 | U.S.S.R. | 239/558 |

*Primary Examiner*—James Hook
*Assistant Examiner*—Davis Hwu
*Attorney, Agent, or Firm*—Rabin & Champagne, P.C.

[57] ABSTRACT

A nozzle device for purging a vacuum pump includes a nozzle, the top portion of the nozzle is a tapered portion, two sides of the tapered portion are installed with nozzle holes for guiding the exhausted air sub-flow to be exhausted from the two sides of vent end.

13 Claims, 5 Drawing Sheets

NOZZLE DEVICE FOR PURGING A VACUUM PUMP

BACKGROUND OF THE INVENTION

The present invention relates to a nozzle device, and especially to nozzles the opening of which do not face to the vent of the compressing chamber of the vacuum pump. Therefore, particles deposited in the vacuum pump are reduced and the gas resistance is also reduced.

In the manufacturing process of semiconductors, vacuum systems are widely used. For example, manufacturing process equipment, for dry etching, ion implantation, and thin film deposition includes expensive machines to be operated in a proper vacuum environment. For the vacuum pump used in the operation of semiconductor plant, the tolerance of the pump is an important consideration. The manufacturing gas will induce particles in the gas channel of a vacuum pump so that the lifetime of a vacuum pump is effected. Therefore, there is an eager demand to reduce the deposition of particles in the gas channel of a vacuum pump.

In this specification, a mechanical vacuum pump is considered. Wherein, a mechanical operation serves to pump gas from the compressing air, then the gas is transferred, compressed, and vented in the pump. Therefore, the effect of vacuuming is achieved. Referring to FIGS. 1 and 2, the vacuum pump 1 is a mechanical Root vacuum pump, which includes rotors 12 rotating within a compressing chamber 11. The rotors 12 and the housing 13 form the gas inlet 14 and gas outlet 15 of the compressing chamber 11. By the driving of the timing gear, the two rotors 12 have equal rotary speeds (a ratio of 1:1). The outlook design of the two rotors 12 has a 1:1 tooth ratio. During the operating process, the two rotors 12 retain a predetermined gap. Therefore, gas can be pumped from the compressing chamber. The performance of the vacuum pump 1 is determined from the precision of the gap of rotors 12. The processing gas is capable of generating particles through reaction in the gas channel of the vacuum pump. Thus, the danger from the deposition of the particles to cause the rotor to seize is decreased so that the vacuum pump must be arranged with a device for purging particles. In general, purging nitrogen is guided into the channel for exhausting particles. A prior art nozzle device used in a roots vacuum pump had a nozzle for spraying purging gas and facing the vent of the compressing chamber. Therefore, particles are easily blown into the compressing chamber. However, this will induce that the rotor to be seized. Besides, the tapered portions directly face the vent, the gas resistance will increase so as to reduce the pumping speed.

SUMMARY OF THE INVENTION

Accordingly, the object of the present invention is to provide a nozzle device, wherein the tapered portions do not face to the vent of the compressing chamber in order to reduce gas resistance and particles are avoided to be blown to the compressing chamber. Thus, the danger that the pump is seized is decreased.

Another object of the present invention is to provide a nozzle device, wherein the flow directions of the spraying gas from the tapered portion are different with one each other and the exhaust gas from the compressing chamber is guided to be exhausted smoothly.

The present invention will be better understood and its numerous objects and advantages will become apparent to those skilled in the art by referencing to the following drawings in which:

DETAILED DESCRIPTION OF THE PREFERRED EMBODIMENT

Figure 1:
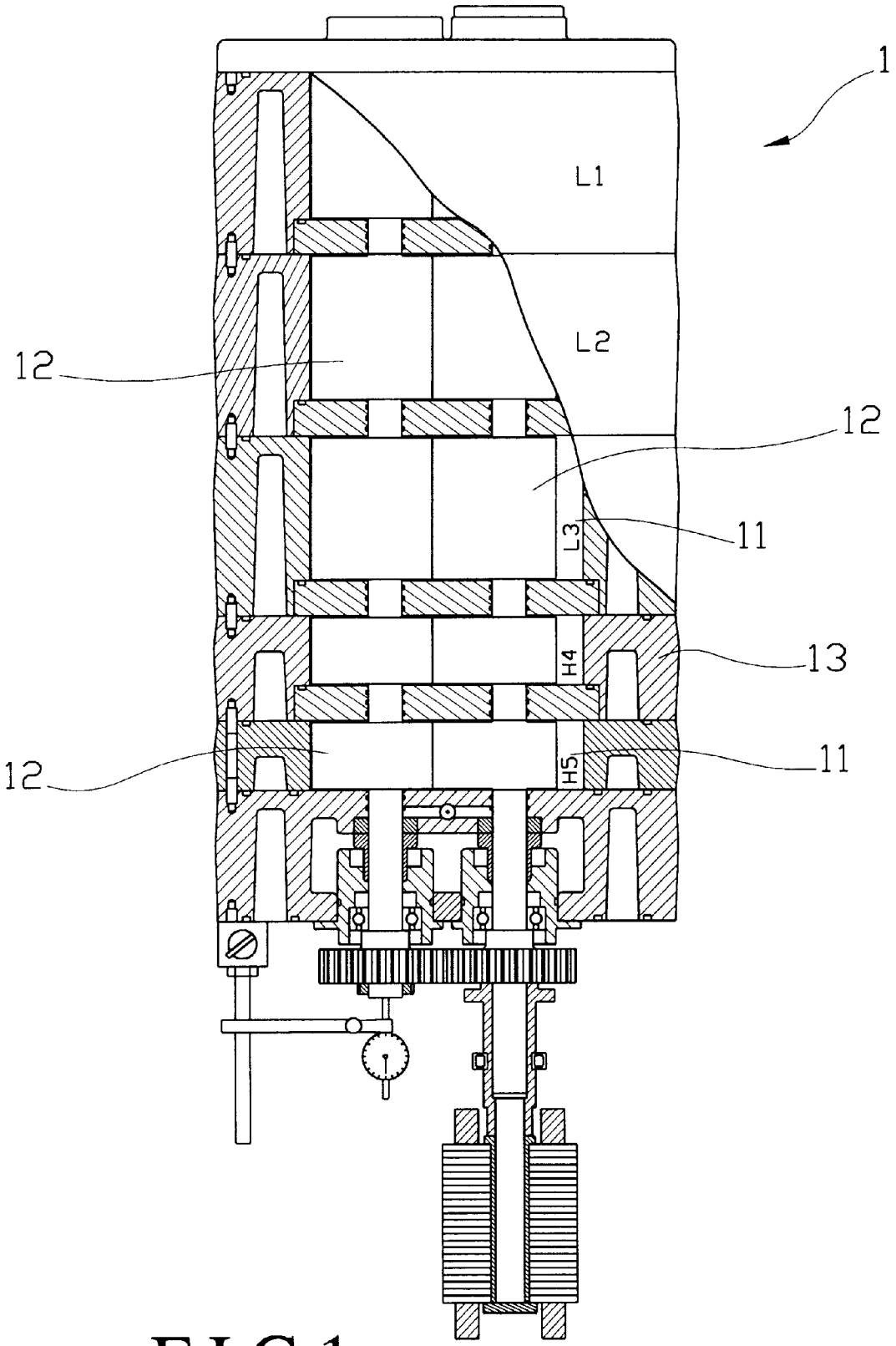
FIG. 1 is a schematic view of a vacuum pump.
Figure 2:
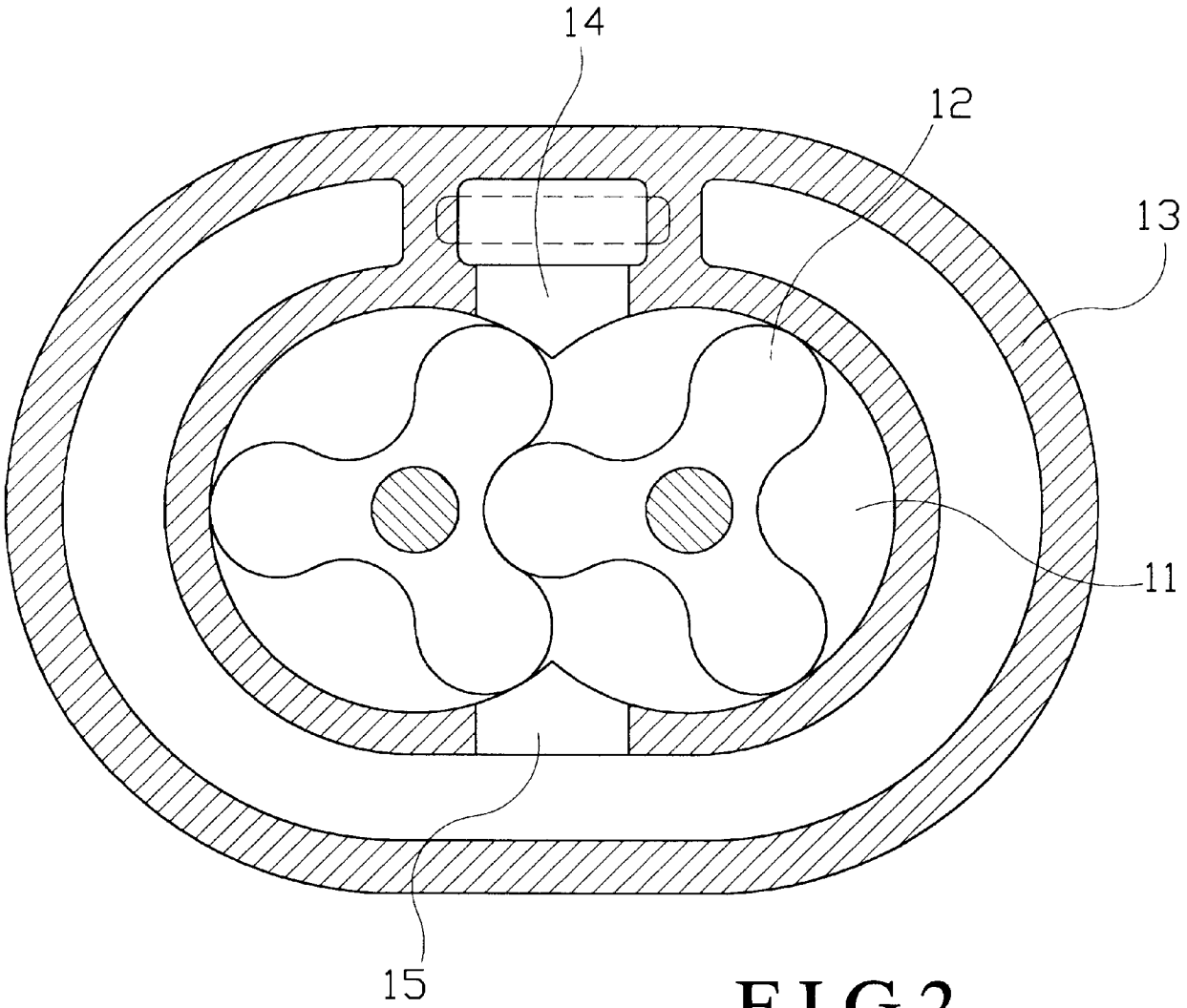
FIG. 2 is a schematic view showing a compression chamber formed by the housing and rotary shaft of FIG. 1.
Figure 3:
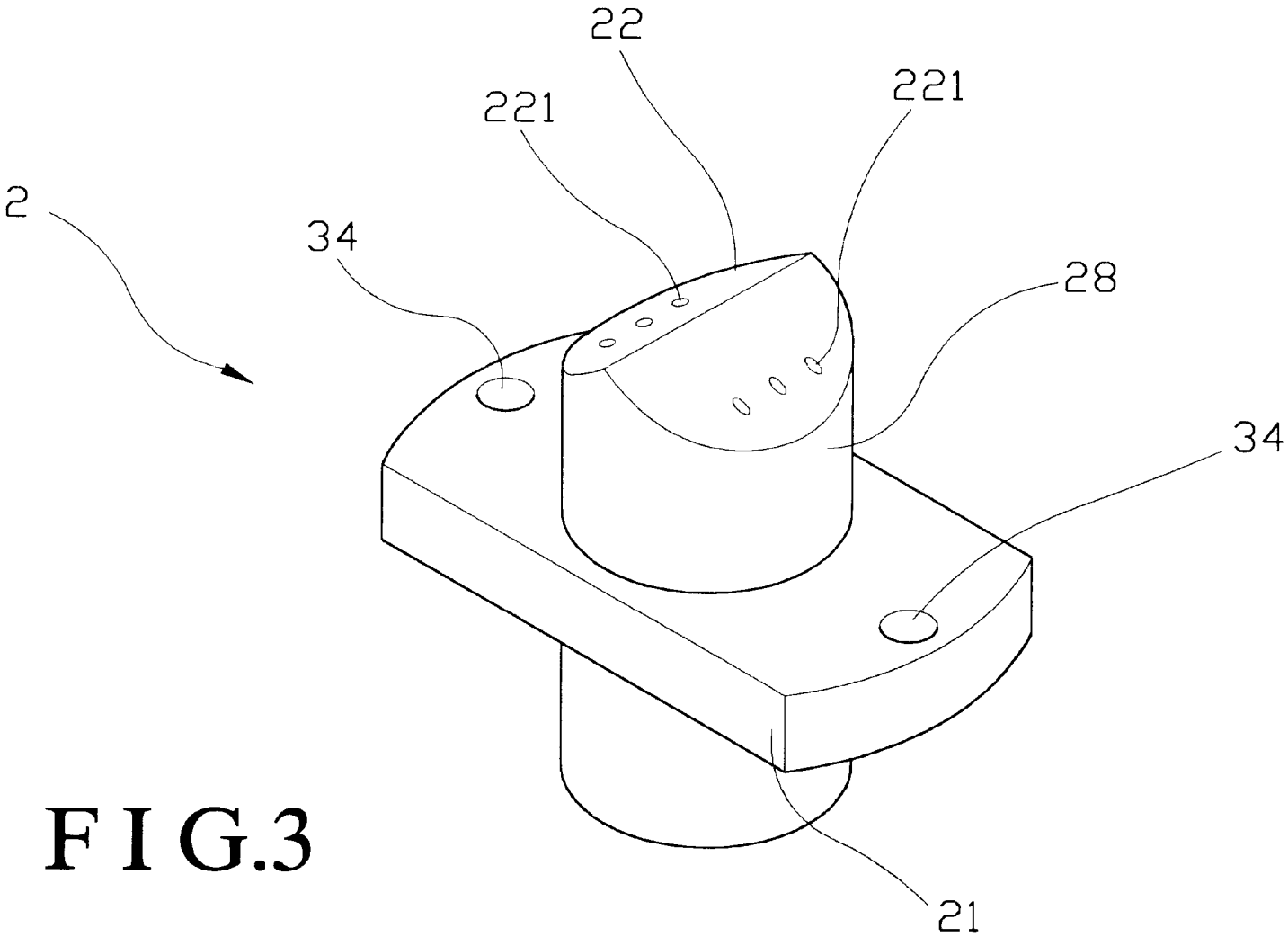
FIG. 3 is a schematic view showing the embodiment of the nozzle device.
Figure 4:
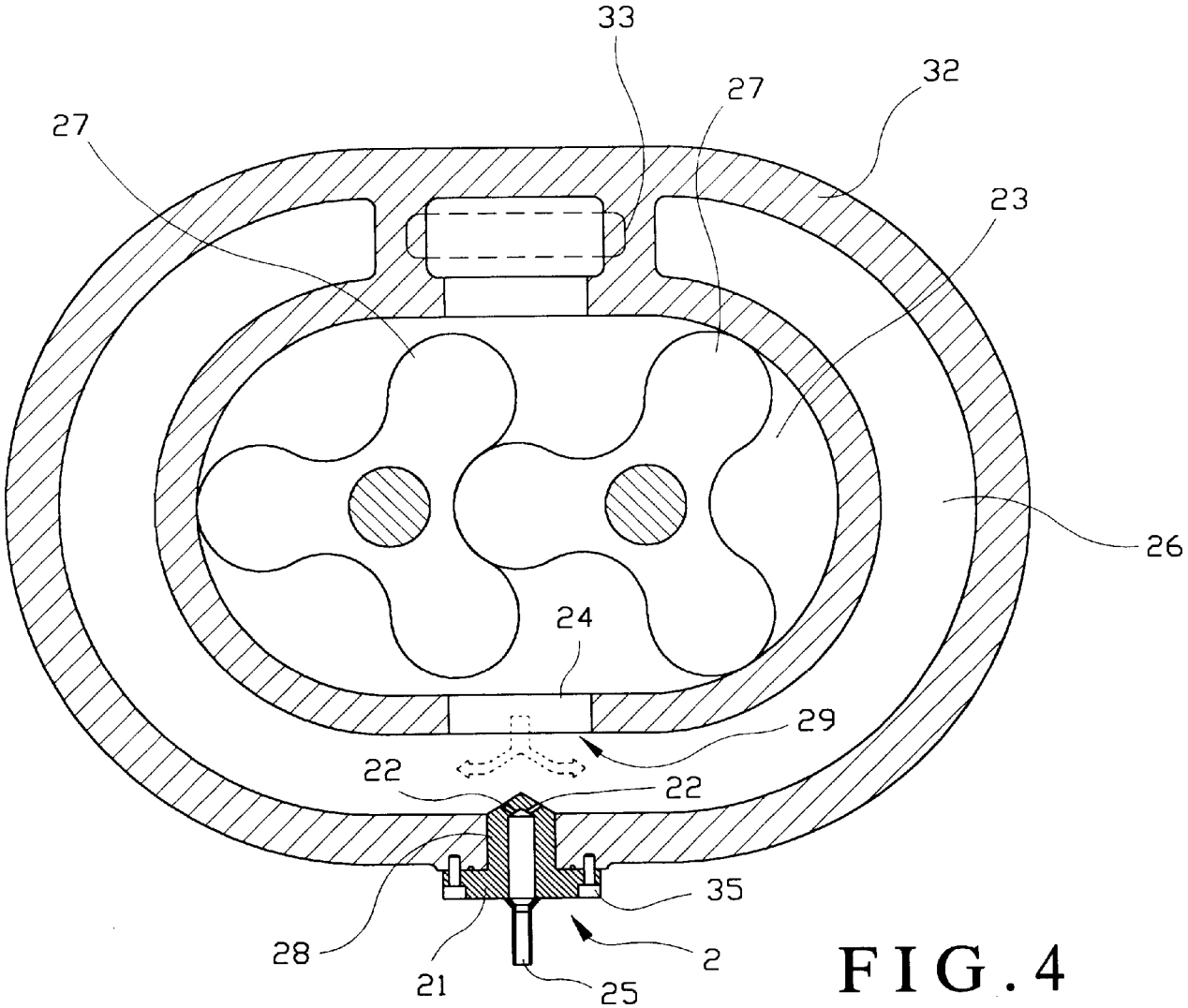
FIG. 4 shows the gas flow of the nozzle device according to the present invention.

Referring now to FIGS. 3 and 4, the nozzle device 2 according to the present invention includes a nozzle body 21 and a nozzle portion 28 firmly secured to the housing 32. The nozzle portion faces toward the vent side 29 of the compression chamber 23. The nozzle portion 28 includes nozzle tapered portions 22 on the top thereof. The nozzle tapered portions 22 are installed with one or a plurality of nozzle holes 221. It is preferred that these nozzle holes 221 are vertical perpendicular to the two sides of the tapered portion 22. The injected air is thus prevented from directly facing the vent 24. In the preferred embodiment of the present invention, the angled tapered portion 22 is installed with a plurality of nozzle holes 221 so that air is sprayed from the two side of the nozzle tapered portion 22 through the nozzle holes, in order to avoid directly facing the vent 24 of the compression chamber 23. In the nozzle device 2, purge air is guided into a straight hole 222 with the nozzle through guide tube 25, then the purge air is guided into the air channel 26. Thereby, the particles are blown and released with the air. Moreover, one end of the straight hole 222 is formed with a thread so as to connect with the guide tube 25. The air sprayed from the angled nozzle hole 221 is not directly facing the vent 24. Thus, the air resistance is reduced and the pumping speed of air is affected and particles are prevented from being blown into the compression chamber 23. Therefore, the problem of seizing of the rotor is prevented. Furthermore, the nozzle portion of the present invention is a tapered body. The nozzle holes 221 are angled with each other along the axial line of the tapered point 281. Thus, the exhausted air flow 3 may be formed as exhausted sub-flows 31 (referring to FIG. 5). As a result, the exhausted air flow 3 will not impact the inner wall of the housing 32, and thus fine particles will not deposit thereon. Further, the air flow formed by the air from the nozzle holes 221 may guide the exhausted sub-flows 31 to be exhausted from the two sides of the vent end 29. Furthermore, the particles in the exhausted air sub-flow 31 will flow to the next stage smoothly, and finally they are released. As a result, the particles will not deposit within the vacuum pump 2 so that the maintenance period of the vacuum pump is prolonged. The angle between the nozzle portions is determined according to the angle of the exhausted air sub-flows, the range therebetween being from 15 degrees to 120 degrees.

Figure 5:
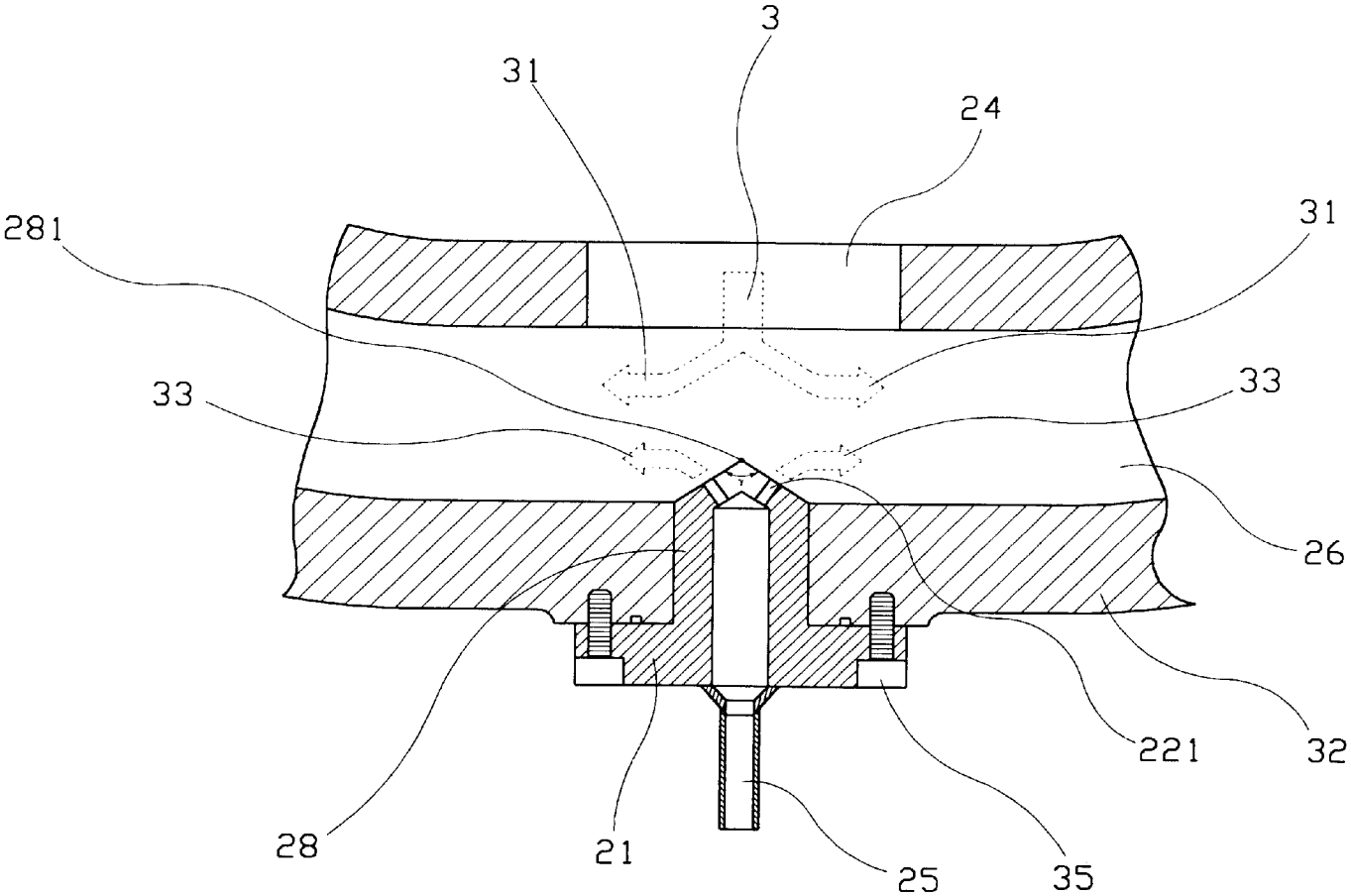
FIG. 5 is a partial enlarged view of FIG. 4.

The nozzle tapered portions 22 does not directly face the vent 24 so as to reduce gas resistance and prevent particles from being blown to the compression chamber 23. In the preferred embodiment of the present invention, the nozzle tapered portions 22 have different spraying angles so as to avoid facing directly the vent 24. The nozzles 22 absorbs purging gas by a guide tube 25. The gas is guided to the gas channel 26 within the housing 32 through the nozzle tapered portions 22. Thereby, particles float out with air, since the angled nozzle tapered portions 22 do not directly face to the vent 24. The gas resistance therebetween is thus reduced, and thus the gas pump speed is affected and particles are prevented from being blown to the compressing chamber 23. As a result, the danger of the rotor 27 being seized is decreased. Moreover, the nozzle portions 28 of the present invention have a tapered shape. The axis of the nozzle tapered portion 22 and the axis of the tapered shape are formed with an angle γ. The exhaust gas flow 3 will form with exhaust gas sub-flows 31 by the top point 281 (as shown in FIG. 5), alternatively, the top point 281 can be replaced by a cambered round surface. Thereby, the exhaust gas 3 is prevented from impacting the inner wall of the housing 32, thus less particles are deposited. Moreover, the airflow 33 formed by the spraying gas from the nozzle tapered portions 22 may serve to guide the flow direction of the exhaust gas sub-flow. Further, the particles of the exhaust sub-flows 31 flow to the gas inlet of the next stage smoothly. Finally, the gas may flow out so that particles are prevented from being deposited within the vacuum pump. Thus, the maintaining period of a vacuum pump is prolonged. The angle γ of the nozzle tapered portion 22 serves to guide the exhaust sub-flows 31. The nozzle tapered portion 22 is a plane or a cambered surface. When the nozzle hole 221 is vertical (perpendicular) to the nozzles 22, a preferred range of the angle γ of the nozzle tapered portion 22 is between 15° to 120°. Thus, the gas flow 33 from the nozzle hole 221 will guide the gas flow 3 to form as a gas sub-flow 31 so as to vent out along the channel 26, in order to prevent the gas flow impacting the inner wall of the housing 32 directly and thus the object of reducing air resistance is achieved. When the nozzle 221 is not vertical to the nozzle tapered portion 22, the orientation of the nozzle 221 can still guide the gas flow 3 to form as gas sub-flows 31 to vent out along the channel 26.

Referring now to FIGS. 3 and 4, a preferred embodiment and the nozzle device 2 of the present invention being firmly secured to the housing 32. Locking holes 34 are installed at proper positions of the nozzle device 21. Locking holes with respect to the locking hole 34 are installed on the housing 32. Thereby, the nozzle device 2 is firmly secured to the housing 32 of the locking element 35.

In the nozzle device of the present invention, by the spraying orientations of the nozzles, the nozzles will not directly face the vent of the compression chamber and particles are prevented from being blown to the compression chamber so that particles will not be blown to the compression chamber. Moreover, the exhaust flow will not directly impact the inner wall of the housing. In addition, the exhaust gas will flow successfully to the outside. The present invention has a better effect than that of the prior art wherein the nozzles and the vent of the compressing chamber are opposite with one another.

Although the present invention has been described using a specified embodiment, the examples are meant to be illustrative and not restrictive. It is clear that many other variations would be possible without departing from the basic approach, demonstrated in the present invention. Therefore, all such variations are intended to be embraced within the scope of the invention as defined in the appended claims.

What is claimed is:

1. A nozzle device in combination with a vacuum pump, comprising:

a vacuum pump housing having a compression chamber therein, and an exhaust vent formed in said housing and being in fluid communication with the compression chamber; and a nozzle having a tapered top portion facing the exhaust vent, the tapered top portion having two sides, with each side having at least one nozzle hole, said nozzle providing a gas through the nozzle holes and towards the exhaust vent, said nozzle guiding gas sub-flows exhausted through the exhaust vent away on two sides of the exhaust vent, thereby preventing a deposition of particles contained in the gas exhausted through the exhaust vent within said housing.

2. The nozzle device and vacuum pump combination according to claim 1, wherein the nozzle includes a nozzle body installed in the housing.

3. The nozzle device and vacuum pump combination according to claim 2, wherein the nozzle body has a locking hole for receiving a locking element so as to fix the nozzle body to the housing.

4. The nozzle device and vacuum pump combination according to claim 1, wherein each side of the tapered top portion has a plurality of nozzle holes.

5. The nozzle device and vacuum pump combination according to claim 4, wherein each nozzle hole is essentially perpendicular to the respective side of the tapered top portion.

6. The nozzle device and vacuum pump combination according to claim 1, wherein a straight hole is formed within the nozzle, the straight hole being in communication with the nozzle holes.

7. The nozzle device and vacuum pump combination according to claim 6, wherein one end of the straight hole is connected to a guide tube for guiding air to the nozzle holes.

8. The nozzle device and vacuum pump combination according to claim 7, wherein the one end of the straight hole is formed with an inner thread for connection to the guide tube.

9. The nozzle device and vacuum pump combination according to claim 1, wherein a tapered point is formed on a tip end of the tapered top portion.

10. The nozzle device and vacuum pump combination according to claim 9, wherein the tapered top portion has a uniformly round taper around the tapered point.

11. The nozzle device and vacuum pump combination according to claim 1, wherein an angle of the tapered top portion is between 15° to 120°.

12. The nozzle device and vacuum pump combination according to claim 1, wherein an angle of the nozzle tapered top portion causes the gas exhausted through the exhaust vent to form as the gas sub-flows to vent out along a channel.

13. The nozzle device and vacuum pump combination according to claim 1, wherein the gas provided through the nozzle holes changes a direction of a flow of the gas exhausted through the exhaust vent and forms the gas sub-flows.

* * * * *